United States Patent [19]

Glas

[11] 4,122,993

[45] Oct. 31, 1978

[54] PRESSURE-EQUALIZING VALVE FOR A PACKAGING CONTAINER

[75] Inventor: Willi Glas, Renningen, Fed. Rep. of Germany

[73] Assignee: Robert Bosch GmbH, Stuttgart, Fed. Rep. of Germany

[21] Appl. No.: 714,636

[22] Filed: Aug. 16, 1976

[30] Foreign Application Priority Data

Aug. 21, 1975 [DE] Fed. Rep. of Germany ..... 2537317

[51] Int. Cl.[2] ..... B65D 31/14

[52] U.S. Cl. ..... 229/62.5; 137/855; 229/DIG. 14

[58] Field of Search ..... 137/855; 229/62.5, DIG. 14; 150/9; 220/209

[56] References Cited

U.S. PATENT DOCUMENTS

| | | | |
|---|---|---|---|
| 2,821,338 | 1/1958 | Metzger | 229/62.5 |
| 2,927,722 | 3/1960 | Metzger | 229/62.5 |
| 2,946,502 | 7/1960 | Metzger | 229/62.5 |
| 3,432,087 | 3/1969 | Costello | 229/62.5 |
| 4,000,846 | 1/1977 | Gilbert | 229/62.5 |

*Primary Examiner*—Stephen P. Garbe
*Attorney, Agent, or Firm*—Edward E. Sachs

[57] ABSTRACT

A packaging container having a pressure equalizing or venting valve which includes a valve seat, a pair of opposed faces and a valve opening therebetween. One of the faces is adapted to be secured to a wall of the packaging container surrounding an aperture which is located therein. A flexible valve diaphragm at least partially surrounds and substantially covers the valve opening on the other side of the faces and of the valve seat. A separation layer is secured to at least a portion of one of the faces of the valve seat and at least partially surrounds the valve opening. The separation layer is positioned between the other face and the flexible valve diaphragm to establish a pressure equalizing or venting passage extending from the valve opening through the flexible valve diaphragm.

11 Claims, 2 Drawing Figures

PRESSURE-EQUALIZING VALVE FOR A PACKAGING CONTAINER

Figure 1:
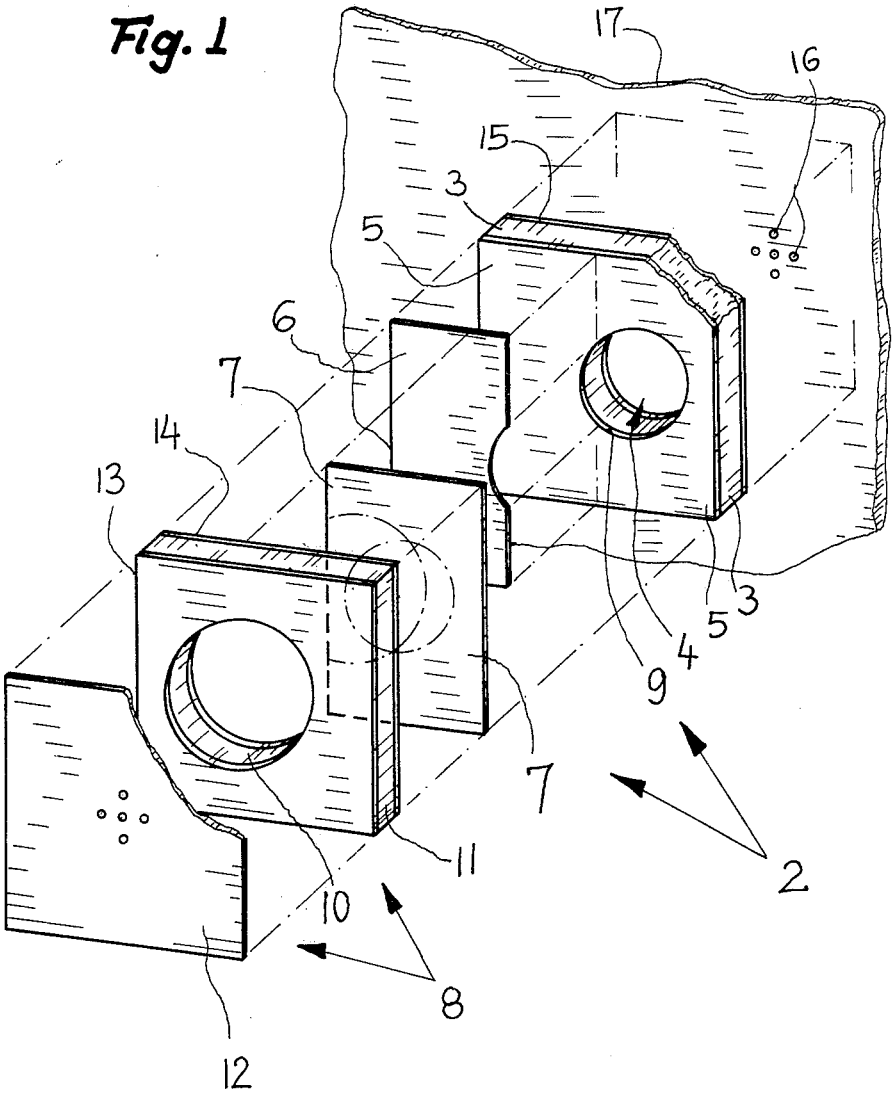

This invention relates to a pressure-equalizing valve, which is particularly suitable for packaging containers which retain a variety of commodities such as, e.g., coffee.

Various types of pressure-equalizing valves are known in the art and typical of the prior art is the device of U.S. Pat. No. 3,082,904 issued Mar. 26, 1963 to F. B. Newcomb et al. In this patent, there is disclosed a container adapted for retaining different commodities such as coffee. It is explained that coffee, after being ground, yields carbon dioxide gas in significant amounts so that it is necessary to store freshly ground coffee for a period of time before it is packaged. However, it is desirable to package such commodities immediately after they are processed — in the case of coffee, shortly after it is ground, for flavor retention purposes. Thus, various proposals have been made for providing pressure-equalizing or venting valves for this purpose so as to permit immediate packaging of commodities such as coffee after they are processed.

In U.S. Pat. No. 3,082,904, the container includes a pressure-equalizing or venting valve in the form of a rigid valve-seat of sheet material which contains a valve opening and a diaphragm which covers the valve opening. The diaphragm is adhesively secured to the valve sheet around a substantially "horse-shoe" shaped area. As will be seen from this reference, the valve seat actually is formed from a portion of the container cover with the valve per se being located under a closure ring within the cover to protect it from damage.

One disadvantage of the above type of valve is that the shape and sizes of the individual components make it relatively expensive to manufacture. Moreover, the valve and the container cover, which form an integral structural unit, render it unsuitable for use with packaging containers which have flexible walls.

Thus, the problem faced by the art is to provide a valve which is economical to manufacture, and which at the same time, can be adapted to various types of packaging containers, particularly of the flexible type.

With the present invention, there is provided an economical valve device for packaging containers, suitable for use with flexible packaging containers, and which overcomes the problems associated with the above type of prior art. More particularly, in accordance with this invention, there is provided a valve device which comprises a valve seat having a pair of opposed faces with a valve opening therebetween, one of the faces being adapted to be secured to a wall of a packaging container surrounding an aperture therein, a flexible valve diaphragm at least partially surrounding and substantially covering said valve opening on the other of said faces of said valve seat, and a separation layer secured to at least a portion of said other of said faces of said valve seat and at least partially surrounding said valve opening and being positioned between said other of said faces and said flexible valve diaphragm whereby there is provided a pressure-equalizing passage extending from said valve opening through said flexible valve diaphragm.

According to preferred embodiments of the above valve device, the valve seat preferably comprises a substantially rigid length of sheet material having the valve opening extending between the opposed faces and this valve seat may be provided with means for securing one of the faces to the wall of a packaging container. The valve seat may also be provided with, on the other of its faces, means for securing it to the release strip and a portion of the valve diaphragm — as explained hereinafter in greater detail. Such means for securing the valve seat to the container wall, and to the release strip and diaphragm, may be for example, various types of adhesive and to this end, the adhesive may totally cover the respective faces of the valve seat for that purpose.

The valve opening, extending between the opposed faces of the valve seat, comprises an aperture adapted to surround an aperture(s) in the container wall; the valve seat opening may take the form of any suitably shaped opening for this purpose and the configuration of the opening may vary according to different requirements for different types of containers. Thus, the opening may be of a generally circular nature, elliptical nature, etc. Typically, in the case of a container wall for a packaging container, the openings therein may be of a relatively small nature and comprise from one to several openings since this will provide sufficient passageway for the escape of gases when required. Thus, the opening in the valve seat should be dimensioned to be of a size sufficient to permit the passage of gases from the container as required.

The flexible valve diaphragm may be made of any suitable material for this purpose, such materials being known to those skilled in this art. It is of a size sufficient to at least partially surround, and preferably totally surround and cover that portion of the valve seat containing the valve opening therein — and as explained above and hereinafter, the release or separation layer at least partially overlaps the diaphragm when the latter is placed in juxtaposition with the valve seat. To this end, the release or separation layer at least partially surrounds the valve opening (but preferably does not cover the valve opening), so that the release layer only covers a portion of the face of the valve seat, with the balance of the valve seat face being covered by the diaphragm and with a flap or portion of the diaphragm overlapping the separating layer. In a particularly preferred embodiment of the present invention, the face of the valve seat may be totally covered with adhesive with the face of the separating layer, and a portion of the face of the diaphragm, covering the adhesive and being secured to the valve seat by means of that adhesive.

In forming the separating layer, and in view of the fact that the release or separating layer at least partially surrounds the valve opening, the release layer will thus have an aperture or a cut-out portion in it to avoid covering the valve opening. In this manner, in view of the fact that the separation layer at least partially surrounds the valve opening in the valve seat, there is thus provided a pressure-equalizing passage by virtue of the non-adhered portion of the valve diaphragm so as to permit any gaseous products from a container to which the valve of the present invention is secured to, to escape.

If desired, the valve device of the present invention may also be provided with a protective covering for sanitary or hygienic purposes. To this end, the protective covering may comprise a first sheet or layer adapted to be placed in juxtaposition with the faces of the separating layer and the valve diaphragm in such a manner so as to surround the valve opening of the valve seat, with such a layer being provided with an aperture therein extending between the opposed faces of the layer. Thereafter, a porous outer layer may be provided which is adapted to be placed in juxtaposition with the aforementioned layer — the outer layer being porous or gas-permeable in at least the portion of the outer layer which covers the opening or aperture of the first layer forming the protective covering.

In the above arrangement utilizing the protective covering for the valve device, the innermost layer of the protective covering with the opening may also be provided with adhesive on its outer face to secure the porous outer covering sheet — or alternately, the porous outer covering sheet may be provided with the adhesive to fixedly secure it to the inner layer.

The material from which the various components of the valve device of the present invention, and the protective covering layer, are made, may be any suitable conventional material for this purpose and suitable substantially rigid materials for the valve seat, flexible materials for the valve diaphragm and appropriate material either of a flexible or a non-flexible nature for the protective covering may be chosen from a wide variety of materials known for such purposes — the choice of the ultimate material being dependent on the particular application of the valve device of the present invention. In this respect, the release or separating layer may also be in the form of a coating of suitable material — e.g., a lacquer as opposed to being a distinct layer such as in the form of a foil or plastic material. By way of example, the protective covering may be formed of an outer layer of a length of perforated foil or plastic material, or even of material such as filter paper.

According to a further aspect of this invention, there is also provided a method of producing the above-described pressure-equalizing valve, and component parts therefor, by the steps of providing a source of continuous valve seat sheet material, providing a source of continuous valve diaphragm material, each of said sources being of a continuous length of the respective materials, said diaphragm material having a width less than the width of the valve seat material, placing the lengths of materials into juxtaposition with each other, and subsequently severing segments of the juxtaposed material from the combined materials to form separated segments suitable for use as pressure-equalizing valve components.

According to a preferred embodiment of this method, the separating or release layer, if it is a separate component layer of the valve device, may also be fed as a continuous length of material into juxtaposition with the length of material adapted to form the seat of the device. The width of the release layer will be characterized as previously described — i.e., it will have a width less than the width of the seat material whereby the release layer is only adapted to partially surround the opening of the seat. In an alternate embodiment within the above-described method, the release layer, if it is in the form of a coating, may be applied to the valve seat sheet material prior to the valve seat material being utilized in the above-described method — i.e., the seat material may be partially coated with a coating of, e.g., lacquer along the length of the sheet material. The width of the coating will be as described above — i.e., less than the width of the sheet material forming the valve seat for the purposes previously described. Again, depending on which embodiment of the invention is employed, the seat material may be coated with an adhesive on one or both sides thereof prior to joinder of the two lengths of material (the valve seat sheet material and the diaphragm material).

In the event the sheet material for the seat is either coated with a coating or is formed by a separate layer of suitable material, the valve seat material may be pre-perforated to provide an opening of the desired size. Thus, in sequence, the valve seat material may be adhesively coated, with subsequent juxtaposition of the release layer onto the valve seat material followed by perforation or punching-out of aperture(s) of the desired shape with subsequent juxtaposition of the valve diaphragm layer, after which the combined continuous lengths of material may be separated into segments forming the pressure-equalizing valve. The above-described operation may be carried out on conventional equipment.

In subsequent processing steps, the protective covering may be applied — likewise, this can be formed by pre-assembling the inner and outer layers of the protective covering — the inner layer having been previously subjected to an aperture-forming operation to provide apertures of the desired size and location therein. If desired, the opposed faces of the inner protective sheet may be provided with adhesive layers — on one side to secure the outer protective covering to the inner layer and on the other side to join the total protective covering to the valve device.

As will be seen from the above-described method, and valve device, there is provided a very economical pressure-equalizing device which may be employed with a variety of different types of containers. The device may be produced by simple steps using readily available materials and thus, complex processing steps are avoided. Moreover, the method of the present invention permits the utilization of materials of the desired width in the form of continuous lengths of such materials so that the materials may be brought into juxtaposition in edge-alignment without the necessity of any subsequent trimming operations. Still further, it is possible to produce continuous lengths of the components for the valve device in a continuous form, which may subsequently be severed into desired valve seat segments then required. The valve of the present invention provides a very efficient means of venting gases from within a packaging container and at the same time provides security against contamination.

Figure 2:
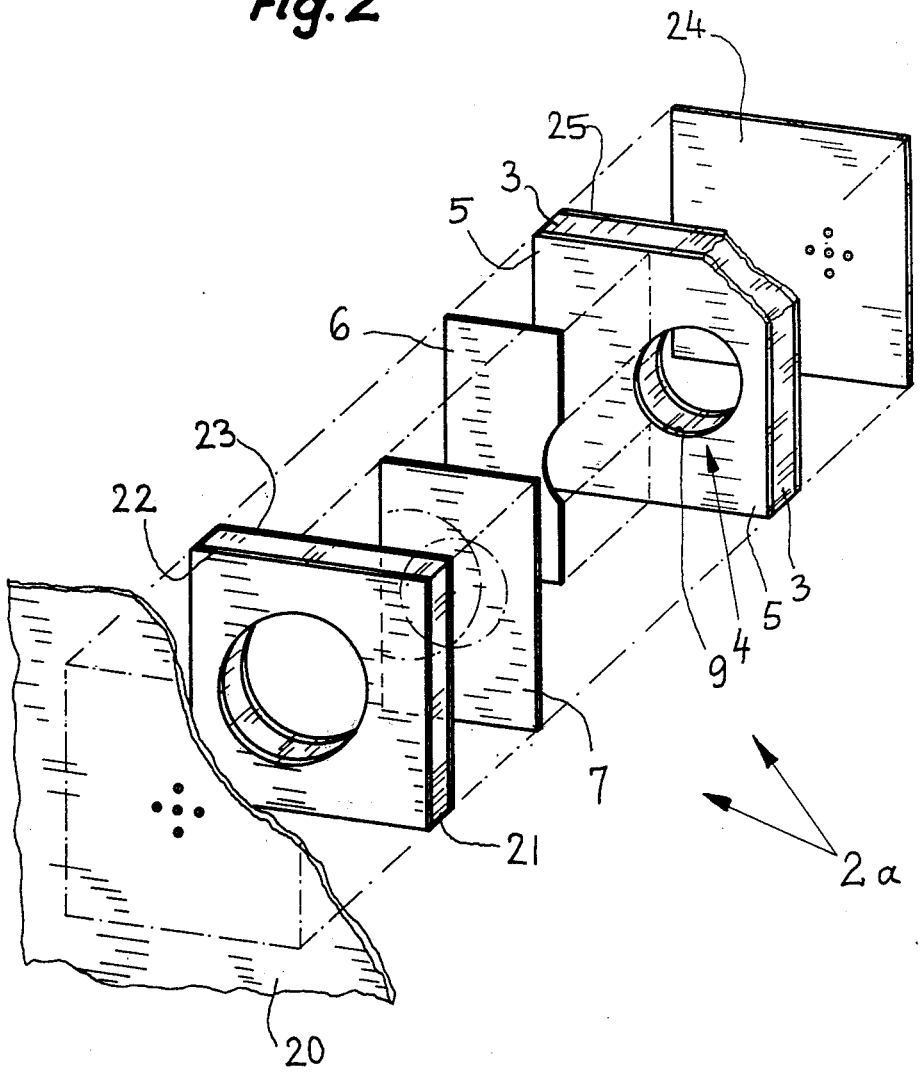

Having thus generally described the invention, reference will now be made to the accompanying drawings, illustrating preferred embodiments, and in which:

FIG. 1 is an exploded view of a first embodiment of a pressure-equalizing device according to the present invention; and FIG. 2 is an exploded view of a further embodiment of the pressure-equalizing device according to the present invention.

Referring initially to FIG. 1, the pressure-equalizing device of the present invention is indicated generally by reference numeral 2 and comprises a valve seat 3 provided with a valve opening 4. The valve seat 3 comprises a layer of suitable material having a pair of opposed faces with the valve opening 4 being positioned inwardly from the side edges of the seat. The valve opening 4 in the embodiment illustrated is of a generally circular nature but as explained previously, the same may be of varying configurations depending on the particular type of application of the device of this invention. In the preferred embodiment, the face of the valve seat 3 adapted to be placed on a container wall, indicated generally by reference numeral 17, with the latter being provided with one or more apertures 16 communicating with the interior of the container, may be provided with a layer of adhesive indicated by reference numeral 15 and which is adapted to secure the seat 3 to the container wall with the valve opening 4 surrounding the apertures 16, as illustrated. Alternatively, if desired, the adhesive 15 may be initially applied to the container wall 17 in the appropriate area with the valve seat 3 being subsequently placed in juxtaposition with the container wall.

FIG. 1 also illustrates a further embodiment where the opposed face of the seat 3, forming the outer face, is also provided with a continuous layer of adhesive 5. A separating or release layer 6 may be secured to the valve seat 3 by means of the adhesive 5 — the release layer 6 in the embodiment shown, having a size sufficient to at least partially surround the valve opening 4 of the seat 3 — and to this end, the release layer 6 includes a recess therein conforming to the periphery 9 of the valve opening 4. As illustrated, the release layer 6 only surrounds a portion of the opening 4; a valve diaphragm 7 is provided which is adhesively secured to the portion of the face of the seat 3 which is not covered by the release layer 6. The valve diaphragm is dimensioned so as to totally surround the aperture 4 of the seat 3, and to extend beyond the aperture and overlap the release layer 6 at least partially. Thus, the portion of the diaphragm 7 that is not adhesively secured to the seat 3 forms a flap which loosely lies in juxtaposition with a portion of the release layer 6 while at the same time covering the valve opening 4.

The protective covering may be utilized with the valve device of the present invention as indicated generally by reference numeral 8 and comprises an inner layer or sheet 11 having an aperture or opening 10 extending therethrough between the opposed faces. The outer layer of the protective covering comprises a porous sheet 12, which may be secured to the inner layer 11 by means of an adhesive 13. The inner layer 11, may in turn, be secured to the separating or release layer 6 and the diaphragm 7 by means of, e.g., an adhesive layer 14. The outer protective porous covering may, as illustrated, contain a plurality of apertures, or as described previously, comprise a layer of porous sheet material 12.

As will be seen from the above description, any pressure within the packaging container, may pass through the opening 16 and through the passageway formed by the valve opening 4, and subsequently through the valve diaphragm by "lifting" the diaphragm away from the separating layer 7 whereby the gas can escape through the protective porous covering 8.

In FIG. 2, there is illustrated an alternate embodiment — similar reference numerals being used to designate similar components as described relative to FIG. 1. In this embodiment, the valve device is generally indicated by reference numeral 2*a*, and includes a valve seat 3 with a valve opening 4 having a layer of adhesive 5 on one face thereof to secure a release layer 6 and a valve diaphragm 7, which permit equalization of the pressure in the container with the exterior, in the manner described above. However, in this case, for the purposes of attaching the valve device to a perforated wall 20 of a packaging container, the pressure-equalizing valve 2*a* may be provided with a perforated attachment flange indicated generally by reference numeral 21. Joining of the device to the container wall 20, and to the valve 2*a*, may be carried out by utilizing adhesive layers 22 and 23. A protective covering 24, in the form of a gas-permeable covering sheet, may be employed and secured to the valve seat 3 by means of, e.g., adhesive layer 25.

It will be understood that various modifications may be made to the above-described embodiments without departing from the spirit and scope of the invention.

I claim:

1. A pressure-equalizing valve suitable for use with packaging containers, said valve comprising a substantially rigid valve seat having a pair of opposed faces with a valve opening therebetween, an adhesive coating at least on one of said opposed faces on said valve seat, a flexible valve diaphragm at least partially surrounding and substantially covering said valve opening on said face with said adhesive coating of said valve seat, a separation layer secured to at least a portion of said adhesive coating on said face of said valve seat and at least partially surrounding said valve opening and being positioned between said coated face and said flexible valve diaphragm whereby there is provided a pressure-equalizing passage extending from said valve opening through said flexible valve diaphragm, and a gas pervious protective covering placed in fixed relation to the container and valve seat.

2. A valve according to claim 1, wherein said separation layer comprises a layer of sheet material, said layer of sheet material having a recess or aperture of a contour conforming generally to the contour of said valve opening.

3. A valve according to claim 2, further comprising an apertured attachment flange associated with one face of said separation layer and with one side of said flexible valve diaphragm.

4. A valve according to claim 3, wherein the container has a wall provided with one or more release openings for venting out gas from the interior of the container; said attachment flange being adapted to interpose between the wall of the container and said layer and said diaphragm and being provided with a gas passage communicating with said pressure-equalizing passage and one or more of said release openings of said container.

5. A valve according to claim 3, wherein said separation layer is composed of sheet material.

6. A valve according to claim 1, wherein said protective covering is secured in juxtaposition with said diaphragm and said separation layer, said protective covering having a gas passage communicating with said pressure-equalizing passage whereby gas may be vented through said pressure-equalizing passage and said gas passage.

7. A valve according to claim 1, wherein one of the faces of the valve seat is secured to a wall of the packaging container surrounding an aperture therein.

8. A valve device according to claim 1, said valve seat comprising a substantially rigid length of sheet material.

9. A valve device according to claim 1, wherein said separation layer comprises a layer of sheet material, said layer of sheet material having a recess extending inwardly of one side of said material and having a contour conforming generally to the contour of said valve opening.

10. A valve device according to claim 1, wherein said protective covering comprises an inner layer having an aperture generally in alignment with the valve opening, and an outer gas-porous layer, said inner and outer layers being adhesively secured together, and said inner layer being adhesively secured to said separation layer and said diaphragm.

11. A valve device according to claim 10, wherein said porous layer comprises a layer of material having apertures therein, said apertures being located in operative relationship to the gas passage of said inner layer.

* * * * *